US010480089B2

(12) United States Patent
Caratini et al.

(10) Patent No.: US 10,480,089 B2
(45) Date of Patent: Nov. 19, 2019

(54) ANODE ASSEMBLY AND ASSOCIATED PRODUCTION METHOD

(71) Applicant: Rio Tinto Alcan International Limited, Montreal (CA)

(72) Inventors: Yves Caratini, La Ravoire (FR); Denis Laroche, Jonquiere (CA); Julien Vallet, Cran-Gevrier (FR); Bertrand Allano, Saint-Nazaire les Eymes (FR); Lyes Hacini, Montreal (CA)

(73) Assignee: Rio Tinto Alcan International Limited, Montreal (CA)

( * ) Notice: Subject to any disclaimer, the term of this patent is extended or adjusted under 35 U.S.C. 154(b) by 64 days.

(21) Appl. No.: 15/111,722

(22) PCT Filed: Jan. 23, 2015

(86) PCT No.: PCT/IB2015/000074
§ 371 (c)(1),
(2) Date: Jul. 14, 2016

(87) PCT Pub. No.: WO2015/110906
PCT Pub. Date: Jul. 30, 2015

(65) Prior Publication Data

US 2016/0348258 A1 Dec. 1, 2016

(30) Foreign Application Priority Data

Jan. 27, 2014 (FR) ..... 14 00171

(51) Int. Cl.
*C25C 3/12* (2006.01)
*C25C 3/16* (2006.01)

(52) U.S. Cl.
CPC ..... *C25C 3/125* (2013.01); *C25C 3/16* (2013.01)

(58) Field of Classification Search
CPC .... C25C 3/06; C25C 3/08; C25C 3/12; C25C 3/125; C25C 3/16; C25C 7/00; C25C 7/005; C25C 7/02; C25C 1/025
See application file for complete search history.

(56) References Cited

U.S. PATENT DOCUMENTS 4,301,387 A * 11/1981 Schiffarth ..... C04B 41/009 313/355
4,612,105 A * 9/1986 Langon ..... C25C 3/125 204/288.2
2009/0250355 A1* 10/2009 Demeulenaere ..... C25C 3/125 205/384

FOREIGN PATENT DOCUMENTS

EP 0188643 A1 7/1986
FR 1326481 A 5/1963
(Continued)

OTHER PUBLICATIONS

Wilkening et al ("Material problems in electrowinning of aluminium by the Hall-Heroult process", Journal of Applied Electrochemistry, 19, 1989, pp. 596-604). (Year: 1989).*
(Continued)

*Primary Examiner* — Alexander W Keeling
(74) *Attorney, Agent, or Firm* — Banner & Witcoff, Ltd.

(57) ABSTRACT

The present invention relates to a manufacturing process for an anode assembly intended for cells for the production of aluminum by electrolysis, the anode assembly being of the type having an anode rod, a longitudinal member interdependent with one end of the anode rod and a carbon anode including a cavity in which is housed the longitudinal member, the method comprising a formation phase of at least one sealed area filled with sealing material and at least one unsealed area devoid of sealing material, said at least one unsealed area extending to one of the longitudinal ends of the longitudinal member.

17 Claims, 3 Drawing Sheets

(56) References Cited

FOREIGN PATENT DOCUMENTS

| | | | | |
|---|---|---|---|---|
| WO | 2005080641 | A1 | 9/2005 | |
| WO | 2012100340 | A1 | 8/2012 | |
| WO | WO-2012100340 | A1 * | 8/2012 | ..... C25C 3/125 |

OTHER PUBLICATIONS

Alaa ("Introduction to Refractories", UO Technology, pp. 1-22).*
May 4, 2015—International Search Report—PCT/IB2015/000074.

* cited by examiner

ANODE ASSEMBLY AND ASSOCIATED PRODUCTION METHOD

CROSS-REFERENCE TO RELATED APPLICATIONS

This application is a U.S. National Stage application under 35 U.S.C. § 371 of International Application PCT/IB2015/000074 (published as WO/2015/110906 A1), filed Jan. 23, 2015, which claims priority to French Patent Application No. FR 1400171, filed Jan. 27, 2014, and the present application claims priority to and the benefit of both of these prior applications, each of which is incorporated by reference in its entirety.

TECHNICAL FIELD

The present invention relates to an anode assembly designed for cells for the production of aluminum by electrolysis, and a method of manufacturing such an anode assembly.

It is particularly suited to electrolytic cells with pre-baked anodes.

PRESENTATION OF PRIOR ART

Aluminum is mostly produced by electrolysis of alumina dissolved in a cryolite bath. The electrolytic cell that makes this operation possible consists of a steel pot shell internally lined with refractory insulating products.

A cathode formed of carbon blocks is placed in the pot shell. It is topped by an anode or a plurality of carbon anodes or carbon anode blocks, dipping into the cryolite bath. This (these) carbon anode(s) is (are) gradually oxidized with oxygen coming from the decomposition of the alumina.

Current flow is from the anode to the cathode through the cryolite bath, maintained in a liquid state by the Joule effect.

As the usual operating temperature of a cell is between 930 and 980° C., the aluminum produced is a liquid and is deposited by gravity on the cathode. Regularly, the aluminum produced, or part of the aluminum produced is sucked up by a casting ladle, and transferred to the casting furnaces. Once the anodes are spent, they are replaced with new anodes.

To allow it to be handled and supplied with electricity, each anode is usually associated with a structure to form an anode assembly. This structure is usually composed of:

- an anode rod made of a material with high electrical conductivity, such as aluminum or copper, and
- fixing means made of materials resistant to the high operating temperatures of the anode, such as steel.

The fixing means generally comprises a multipode formed of a cross member fixed to the base of the rod associated with a plurality of preferably cylindrical stubs whose axis is parallel to the rod.

The stubs are partly inserted inside cavities made on the top face of the anode and the gaps between the stubs and the cavities are filled with molten metal, typically cast iron. The metal bushings made in this way make it possible to ensure good mechanical attachment and good electric connection between the rod and the anode.

However, it has been found in prior art that the presence of stubs causes an ohmic drop at the connection of the anode, and heat loss through the anode assembly.

Therefore document WO 2012/100340 proposes an anode assembly wherein the assembly consisting of the cross member and stub is replaced by a longitudinal connecting bar. During sealing, the connecting bar is inserted into a longitudinal groove made on the top face of the anode. Molten cast iron is then deposited on the edge of the connecting bar to fill the space between the connecting rod and the groove.

This solution improves the current distribution in the anode, reduces the ohmic drop at the contact between the carbon and the cast iron and limits heat loss, as already learned from document FR 1326481, which proposed an identical solution to WO 2012/100340.

However, if the anode assemblies of prior art contained preferably cylindrical stubs, this was to reduce the risk of deterioration of the anode due to the expansion undergone by the fixing means during insertion of the anode into the cryolite bath, the temperature of which is between 930 and 980° C.

Unlike cylindrical stubs whose dilatation induces the application of a radial thermal expansion force on the anode, the thermal expansion of a metal bar cause transverse and longitudinal forces to be applied to the anode, tending to crack it.

No solution to this problem of cracking is proposed in FR 1 326 481 or WO 2012/100340.

One object of the present invention is to provide a more robust anode assembly than those proposed in FR 1 326 481 and WO 2012/100340, this anode assembly making it possible to improve the distribution of currents in the carbon anode, reduce the ohmic drop at the contact between the carbon and the cast iron and limit the thermal losses of the electrolytic cell through the steel conductors entering the carbon anode.

Another object of the present invention is to provide a method of manufacturing such a robust anode assembly.

SUMMARY OF THE INVENTION

To this end, the invention proposes a method of manufacturing an anode assembly intended for cells for the production of aluminum by electrolysis, the anode assembly being of the type having an anode rod, a longitudinal member interdependent with one end of the anode rod and a carbon anode including a cavity in which is housed the longitudinal member for sealing the longitudinal member to the carbon anode, remarkable in that the method comprises a formation phase of at least one sealed area filled with sealing material and at least one unsealed area devoid of sealing material, said at least one unsealed area extending to one of the longitudinal ends of the longitudinal member.

The longitudinal member is therefore sealed in the carbon anode to establish mechanical coupling and electrical connection, and the fact that one of the longitudinal ends of the longitudinal member is free of sealing material makes it possible to limit the risks of cracking of the carbon anode.

The presence of a volume having no sealing material at one of the longitudinal ends of the longitudinal member can limit the intensity of the forces applied to the anode by the longitudinal member when expanding, more particularly expanding in the longitudinal direction of the longitudinal member.

Advantageously, the formation phase may include:

- formation of a sealed area filled with sealing material, said sealed area extending between the longitudinal side faces of the longitudinal member and the longitudinal internal walls of the cavity, and
- formation of two unsealed areas at both longitudinal ends of the longitudinal member, each unsealed area extending between a transverse side face of the longitudinal member and a transverse internal wall of the cavity.

In this case, the anode assembly comprises two unsealed areas, each unsealed area extending to a respective longitudinal end of the longitudinal member. The unsealed areas are then distributed on either side of the anode rod, which firstly allows better distribution of the intensity of the expansion forces, and secondly, gives a better mass balance of the anode assembly.

The formation phase may include a step of placing shuttering material in a gap between the longitudinal member and the internal walls of the cavity—such that the longitudinal internal walls and optionally a base of the cavity—so as to define at least one sealing area and at least one non-sealing area. To do this, the shuttering material may be placed at at least one end of the longitudinal member so that the shuttering material extends on the longitudinal side faces of the longitudinal member. Once the shuttering material has been placed, the longitudinal member can be inserted with the shuttering material into the cavity so that the shuttering material defines, with the internal walls of the cavity and the faces of the longitudinal member, sealing and non-sealing areas. Having the shuttering material on the longitudinal member prior to its insertion into the cavity facilitates fitting of the shuttering material. This also ensures better control of the position of the shuttering material.

In an alternative embodiment, the shuttering material is a mat. It may be fixed to the longitudinal member by gluing or tying around the longitudinal side faces and a bottom face of the longitudinal member. The fact that the shuttering material extends on the underside of the longitudinal member makes it possible to define a space under the longitudinal member wherein the sealing material can be inserted. Inserting the sealing material between the underside of the longitudinal member and a base of the cavity improves current distribution in the anode.

Preferably, the formation step comprises a step involving filling the sealing area by pouring the sealing material in liquid or viscous state. Casting the sealing material in liquid or viscous state ensures good distribution of sealing material throughout the sealing area.

The formation phase may also comprise a step involving removing the shuttering material after the filling step, and optionally a packing step of the unsealed area with the packing material. This limits the risk of clogging of the unsealed area(s) with a material used in the manufacture of aluminum. Such clogging may in some cases result in an increased risk of anode cracking.

The invention also relates to an anode assembly intended for cells for the production of aluminum by electrolysis, the anode assembly having an anode rod, a longitudinal member interdependent with one end of the anode rod and a carbon anode including a cavity in which is housed the longitudinal member, remarkable in that anode assembly additionally comprises a gap between the cavity and the longitudinal member, the gap including at least one sealed area containing a sealing material and at least one unsealed area devoid of sealing material, and said at least one unsealed area extending to one of the longitudinal ends of the longitudinal member.

Preferred but not limiting aspects of the anode assembly are:

the anode assembly comprises at least two unsealed areas at both longitudinal ends of the longitudinal member, and at least one sealed area extending between the longitudinal side faces of the longitudinal member and the longitudinal internal walls of the cavity, the sealed area further extends between a lower face of the longitudinal member and a base of the cavity, the unsealed area comprises the packing material, said packing material being compressed to a nominal value sufficiently lower than the maximum compression ratio to allow expansion of the longitudinal member, the packing material is rock wool.

According to an advantageous embodiment, the anode assembly includes a support to which is attached a plurality of anode rods, longitudinal members and carbon anodes. The support extends more particularly horizontally perpendicular to the longitudinal members.

BRIEF DESCRIPTION OF THE FIGURES

Other advantages and characteristics of the anode assembly and its manufacturing method will emerge from the description which follows of several alternative embodiments, given as non-limiting examples, from the appended drawings in which:

FIG. 7 illustrates the steps of a formation phase of the sealing method, and FIG. 8 schematically illustrates an anode assembly including a plurality of anodes.

DETAILED DESCRIPTION

Figure 1:
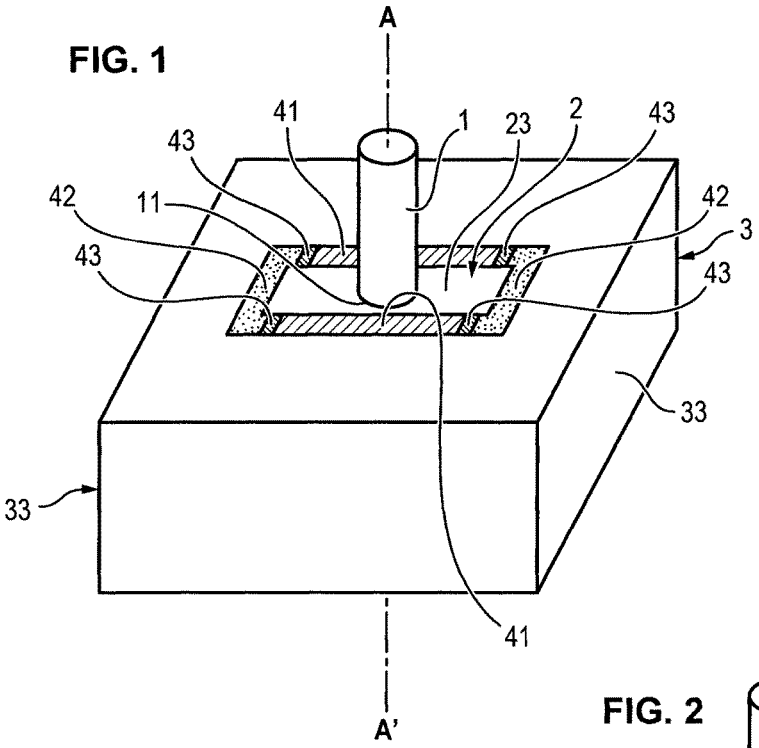
FIG. 1 is a perspective view of the anode assembly.

We will now describe an example of the method of manufacturing an anode assembly and examples of anode assemblies obtained from the process. In these different figures, equivalent elements bear the same reference numerals.

In the following text the expressions "side face", "bottom face", "top face", "side walls" and "base" will be used with reference to an anode rod extending along an axis A-A'.

The reader will appreciate that in the context of the present invention:

"lower face" or "lower face" mean a face extending in a plane perpendicular to the axis A-A', the upper face of a given piece being closer to the anode rod than the lower face, "side face/wall" means a face/wall extending in a plane parallel to the axis A-A' of the anode rod, "longitudinal face/wall" means a face/wall extending parallel to a longitudinal axis of a longitudinal object (for example a cavity or a longitudinal member)

"transversal face/wall" means a face/wall extending perpendicularly to a longitudinal axis of a longitudinal object.

Figure 2:
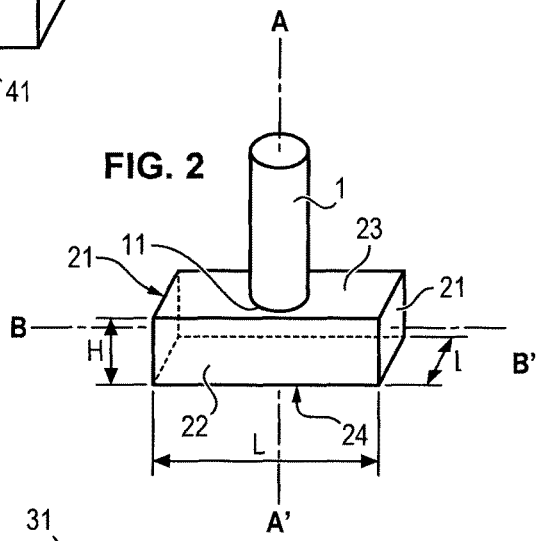
FIG. 2 is a perspective view of a longitudinal member and an anode rod.
Figure 3:
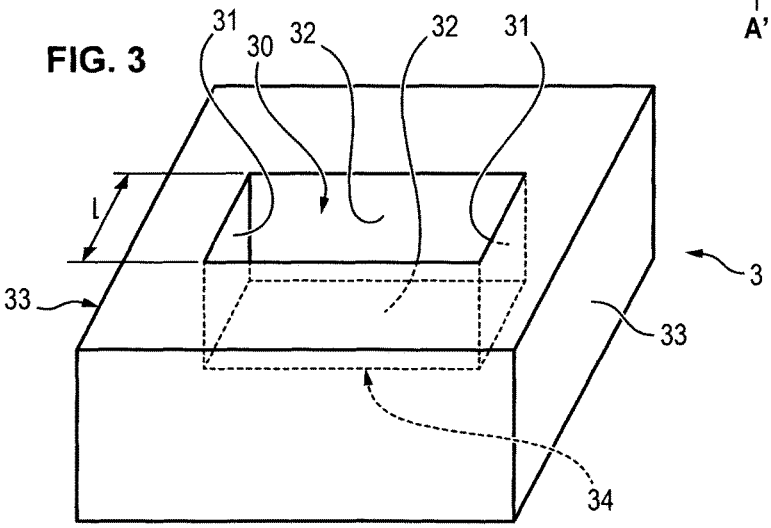
FIG. 3 is a perspective view of an anode including a cavity in its upper surface.

FIG. 1 shows an example of an anode assembly according to the invention. Referring to FIGS. 1 to 3, the anode assembly comprises an anode rod 1, a longitudinal member 2, and a carbon anode 3.

The anode rod 1 is made of an electrically conductive material. It extends along the axis A-A'. The anode rod is of a type conventionally known to those skilled in the art and will not be described in more detail later.

The longitudinal member 2 forms fixing means. The longitudinal member 2 is made of an electrically conductive material capable of withstanding the high operating temperatures of the anode assembly. For example, the longitudinal member is made of steel.

The dimensions of the longitudinal member 2 may be as follows:

length L between 80 and 200 centimeters, width I and height h between 5 and 50 centimeters.

In all cases, length L is at least twice the width I of the longitudinal member 2.

The longitudinal member 2 is interdependent with the anode rod 1 at one of its ends 11, and extends along a longitudinal axis B-B' perpendicular to axis A-A'. The longitudinal member 2 comprises an upper face 23 in contact with the anode rod 1, a bottom face 24 opposite the upper face 23, two longitudinal side faces 22 and two transverse side faces 21. The longitudinal member 2 is for example a bar, possibly rectangular, and may include teeth, particularly with a rounded profile on its side faces 21, 22 and/or its lower face 24.

Anode 3 is an anode block made of pre-baked carbon material, the composition and the general shape of which are known to those skilled in the art and will not be described in more detail later. The upper face of anode 3 has a cavity 30 in which longitudinal member 2 is housed.

Advantageously, cavity 30 may be of complementary shape to that of the longitudinal member 2. In this case, cavity 30 includes internal longitudinal side walls 32, transverse inner side walls 31 and a base 34.

Alternatively, cavity 30 may consist of a groove extending between the two side edges 33 of anode 3. This facilitates the process of forming the cavity 30.

Width I of the cavity or groove is planned to be greater than the width of the longitudinal member 2 to enable the longitudinal member 2 to be inserted.

The anode assembly further comprises sealed areas filled with a sealing material 41. The sealed areas extend between the longitudinal internal walls 32 of cavity 30, and the longitudinal side faces 22 of the longitudinal member 2.

In the context of the present invention, "sealing material" is understood to mean a material for forming a rigid and conductive connection between an anode and a longitudinal member, said connection being typically provided by a metal cast between the longitudinal member and the anode such as cast iron, or by a conductive paste.

As illustrated in FIGS. 1 and 4 to 6, the sealing material 41 does not cover all the lateral faces 21, 22 of the longitudinal member 2. The sealing material 41 covers only the longitudinal side faces 22, with the possible exception of peripheral portions of the longitudinal side faces located at the longitudinal ends of the longitudinal member 2.

In other words, the anode structure includes unsealed areas at the longitudinal ends of the longitudinal member 2, each end being composed of a transverse side face 21 and possibly an end portion of the longitudinal side faces 22.

Optionally the lower face 24 may also be covered with the sealing material 41, with the possible exception of peripheral portions of the lower face 24 located at the longitudinal ends of the longitudinal member 2. The fact that the lower face 24 is at least partially covered with the sealing material 41 improves the conduction of current between longitudinal member 2 and anode 3.

The unsealed areas are therefore devoid of sealing material 41. This makes it possible to define enough free space to ensure that the forces applied longitudinally by the longitudinal member 2 during its expansion are less than the cracking limit value of anode 3.

As a guide, it is recalled that a longitudinal length of steel member 1 m long may undergo longitudinal expansion of up to 2 centimeters at 1000° C. It is then understood that longitudinal expansion can induce very substantial deterioration of anode 3 (cracks, bursting, etc.) when longitudinal member 2 is covered with sealing material 41 on all its lateral faces 21, 22.

Unsealed areas can be left empty.

Alternatively, the unsealed areas may be filled, in whole or part, with a compressible packing material 42, possibly one that returns to its original shape, such as rock wool. This avoids the risk of clogging the unsealed areas with heaps of non-compressible material coming, for example from covering material powders, which could transmit the expansion stresses of the longitudinal member to anode 3.

Preferably, the packing material 42 is compressed to a nominal value sufficiently lower than its maximum compression ratio to allow expansion of the longitudinal member while limiting the forces applied to anode 3.

In addition to the packing material 42, the unsealed areas may comprise shuttering material 43 between the sealing material 41 and packing material 42. This shuttering material 43 is used to define a containment volume corresponding to a sealing area (i.e. area to be sealed) in which the sealing material 41 is inserted during the manufacturing process of the anode assembly to be described in more detail in the following.

The shuttering material 43 is preferably a compressible material resistant to high temperatures without deteriorating or burning, such as vitreous, refractory, ceramic or preferably biosoluble fibers such as e.g. Insulfrax® Fiberfrax®.

Figure 4:
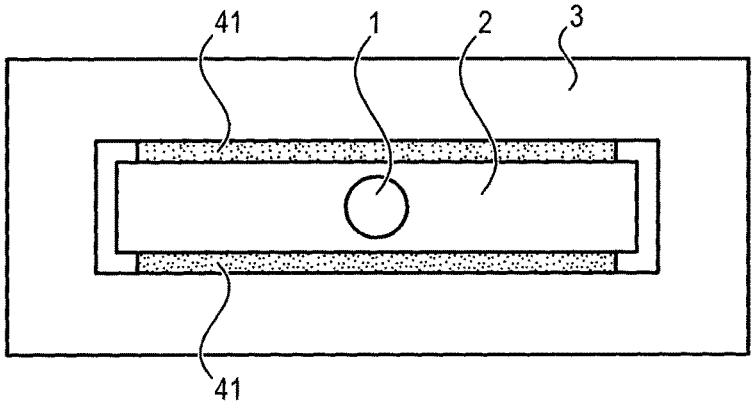
FIGS. 4 to 6 are top views of different examples of anode assemblies.
Figure 5:
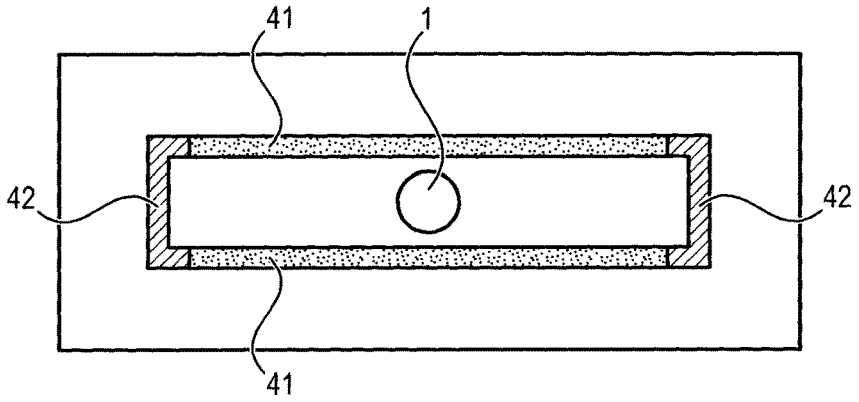
Figure 6:
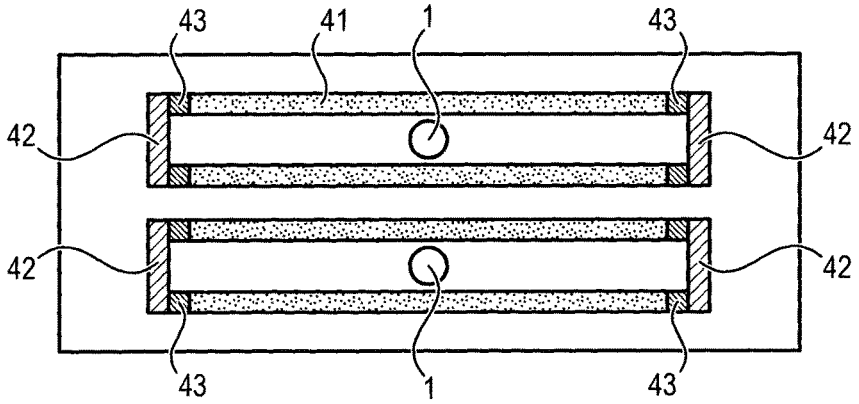

Referring to FIGS. 4 to 6, various embodiments of the anode assembly are illustrated as top views.

As illustrated in FIG. 4, the gap between cavity 30 and longitudinal member 2 may comprise only sealed areas filled with sealing material 41 and unsealed areas devoid of material. To achieve this, the shuttering material 43 is removed from the anode assembly after filling the sealing areas, and no filler material is inserted into the longitudinal ends of the longitudinal member 2.

As illustrated in FIG. 5, the gap between cavity 30 and longitudinal member 2 may comprise sealed areas filled with sealing material 41 and unsealed areas containing only packing material 42 (i.e. no shuttering material). To do this, the shuttering material 43 is removed after forming the sealed areas and packing material 42 is inserted into the longitudinal ends of the longitudinal member 2.

Finally, as shown in FIG. 6, the anode assembly may include one or more related cavities 30 and longitudinal members 2. Each gap may include sealed areas filled with sealing material 41, unsealed areas composed of packing material 42 and shuttering material 43.

Whatever the embodiment, the anode assembly comprises at least one unsealed area situated at one of the longitudinal ends of the longitudinal member 2, said unsealed area being free of (i.e. not containing) sealing material.

Preferably, and as illustrated in the various figures, the anode assembly comprises two unsealed areas, each unsealed area extending to a respective longitudinal end of the longitudinal member. This allows better distribution of currents in the anode, the intensity of the expansion forces, and better balancing of the masses of the anode assembly by improving its symmetry relative to axis A-A'.

Figure 7:
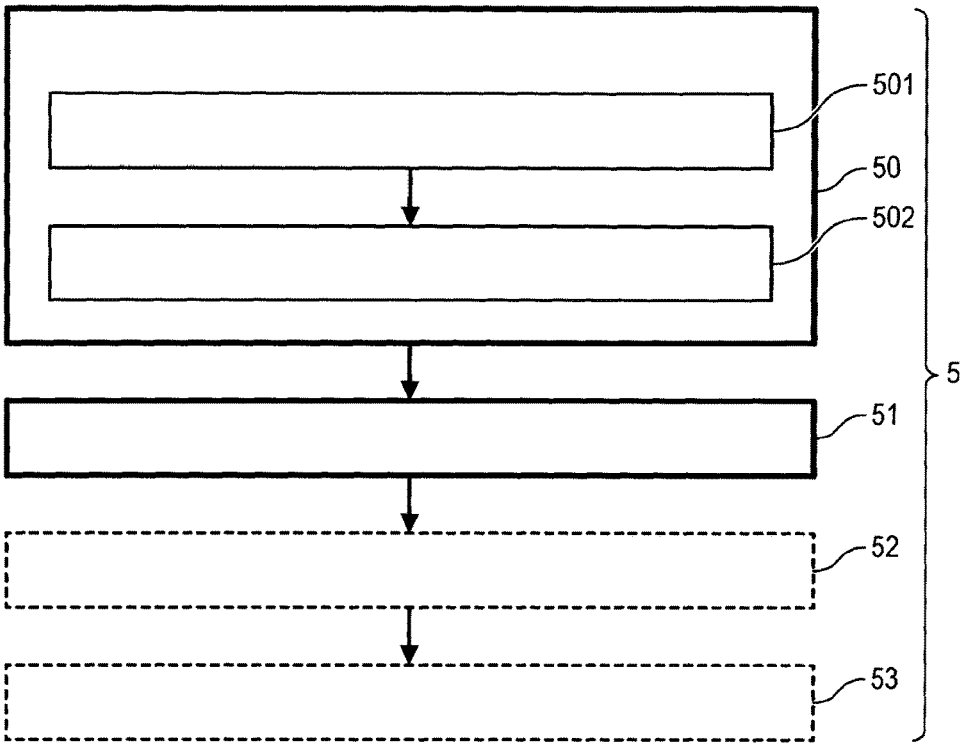
FIG. 7 is a block diagram of a method of sealing an anode assembly; specifically

We will now describe an example of the method of sealing a longitudinal member 2 to a carbon anode 3 to obtain an anode assembly. More specifically, we will describe below, with reference to FIG. 7, a phase of formation 5 of sealed and unsealed areas of the sealing process.

This formation phase 5 may be applied to form a single non-sealed area and a single sealed area, the unsealed area extending to one of the longitudinal ends of the longitudinal member 2 and the sealed area extending over all the rest of the volume defined between the cavity 30 and the longitudinal member.

Alternatively, this formation phase 5 may be applied to form two unsealed areas at the longitudinal ends of the longitudinal member 2, and one (or several) sealed area(s).

In the following, we assume the manufacture of an anode assembly including two unsealed areas each associated with a respective longitudinal end of the longitudinal member 2. It is also assumed that cavity 30 of anode 3 has been previously made, by molding or any other technique known to those skilled in the art.

In a one step 50 of the method, a shuttering material 43 is fitted to define:

at least one "sealing area" (i.e. area to be sealed) in which it is desired to insert the sealing material, and two "non-sealing areas" (i.e. area not to be sealed) in which it is desired to avoid the presence of sealing material.

The shuttering material 43 may be fitted either onto the longitudinal member 2, or directly in the cavity 30.

This shuttering material 43 may be a mat of vitreous fibers having a diameter greater than or equal to the distance between the longitudinal side faces 22 and the longitudinal internal walls 32 opposite. The use of a mat facilitates the operation of fitting the shuttering material 43.

This mat can for example be placed 501—optionally by gluing or tying—on the longitudinal member 2, prior to its insertion into cavity 30.

Once the mat has been placed, the longitudinal member 2 is inserted 502 into the cavity 30. The mat is compressed between the longitudinal side faces and the longitudinal internal walls.

Advantageously, the mat may have non-zero radial elasticity. This ensures that the mat is in contact firstly with the longitudinal member 2 and secondly with the internal walls of the cavity 30, even when one (or several) fixing groove(s) are arranged in the longitudinal internal walls 32 of the cavity 30 to improve fixing between the sealing material and the anode.

Advantageously, the mat can be arranged on the lower face of the longitudinal member 2 (in addition to the longitudinal sides). Once the longitudinal member 2 has been inserted into the cavity 30, this creates a space between the lower face 24 and the base 34. With the formation of this space, it is possible to deposit the sealing material 41 between the base 34 and the lower wall 24. This makes it possible to improve the electrical performance of the anode assembly so obtained.

The longitudinal side faces 22, the longitudinal internal walls 32 and the shuttering material 43—and possibly the lower face 24 and the bottom 34—define a containment volume corresponding to the sealing area. The transverse side faces 21, the transverse internal walls 31 and the mat 43 define two non-sealing areas at the longitudinal ends of longitudinal member 2.

In another step 51, a sealing material 41 in liquid or viscous state, is inserted into the sealing area, optionally by casting. The sealing material 41 is deposited between the longitudinal side faces 22 and the longitudinal internal walls 32.

Once the sealing material 41 has solidified, the mat can be removed (step 52) to form unsealed areas devoid of shuttering material 43.

Alternatively, the mat may be left in place in the unsealed areas.

Non-sealing areas can then be filled (step 53) with a packing material 42.

This gives an anode assembly comprising at least one unsealed area located at one of the longitudinal ends of the longitudinal member. This limits the risk of cracks and/or bursting of anode 3 when it is inserted into a cryolite bath.

Figure 8:
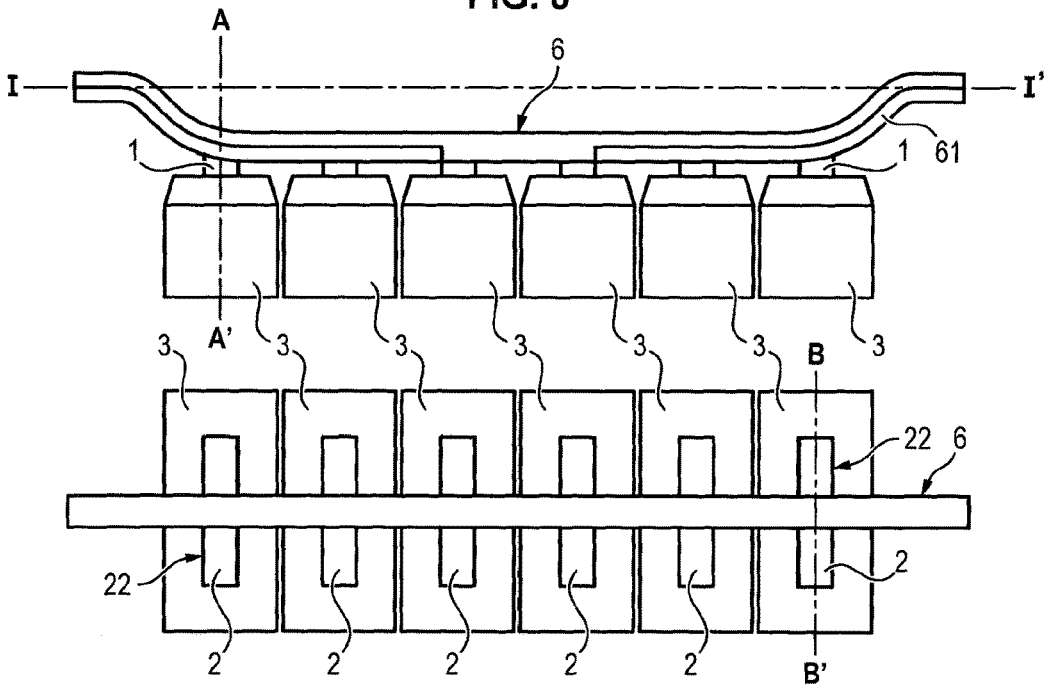

As illustrated in FIG. 8, the method described above can be used to produce an anode assembly of large width. Such an anode assembly is then made up of a longitudinal support 6 extending horizontally including an electric switch 61 at at least one of its ends for the power supply to anode sub-assemblies suspended from support 6, each anode sub-assembly being fixed to support 6 by means of its associated anode rod 1, the longitudinal members 2 extending transversely in relation to support 6 so that a longitudinal axis I-I' of the support is perpendicular to the longitudinal side faces 22 of the longitudinal members 2. The support advantageously extends from one side to the other of the electrolytic cell and is supported and electrically connected at its ends.

The invention claimed is:

1. A method of manufacturing an anode assembly intended for cells for production of aluminum by electrolysis, the anode assembly having an anode rod, a longitudinal member interdependent with one end of the anode rod and a carbon anode including a cavity in which is housed the longitudinal member for sealing the longitudinal member to the carbon anode, the longitudinal member having longitudinal ends, characterized in that the method comprises a formation phase comprising forming at least one sealed area within a gap between internal walls of the cavity of the carbon anode and the longitudinal member filled with sealing material and at least one unsealed area within the gap devoid of sealing material, the at least one unsealed area extending directly from and in contact with one of the longitudinal ends of the longitudinal member, wherein the formation phase includes fitting a shuttering material into the gap so as to define at least one sealing area and at least one non-sealing area, and filling the sealing area by casting of the sealing material in liquid or viscous state.

2. A method according to claim 1, wherein the at least one sealing area comprises a first sealed area and the at least one non-sealing area comprises a first and a second unsealed areas, and the formation phase further comprises:

forming the first sealed area filled with sealing material, the first sealed area extending between longitudinal side faces of the longitudinal member and longitudinal internal walls of the cavity, and forming the first and second unsealed areas at both longitudinal ends of the longitudinal member, each of the first and second unsealed areas extending between a transverse side face of the longitudinal member and a transverse internal wall of the cavity.

3. A method according to claim 1, wherein the fitting step comprises:

placing the shuttering material at at least one of the longitudinal ends of the longitudinal member so that the shuttering material extends on longitudinal side faces of the longitudinal member, and inserting the longitudinal member with the shuttering material into the cavity so that the shuttering material defines, with the internal walls of the cavity and the side faces of the longitudinal member, the at least one sealing area and the at least one non-sealing area.

4. A method according to claim 3, wherein the placing of the shuttering material comprises gluing or tying of at least one mat around the longitudinal side faces and a lower side of the longitudinal member.

5. A method according to claim 1, wherein the formation phase further comprises removing the shuttering material after the filling of the sealing area.

6. A method according to claim 1, wherein the formation phase further comprises packing the unsealed area with packing material.

7. An anode assembly intended for cells for production of aluminum by electrolysis, the anode assembly having an anode rod, a longitudinal member interdependent with one end of the anode rod and a carbon anode including a cavity in which is housed the longitudinal member for sealing the longitudinal member to the carbon anode, the longitudinal member having longitudinal ends, characterized in that the anode assembly further comprises a gap between the cavity and the longitudinal member, the gap including at least one sealed area containing a sealing material and at least one unsealed area devoid of sealing material, the at least one unsealed area extending directly from and in contact with one of the longitudinal ends of the longitudinal member.

8. An anode assembly according to claim 7, wherein the at least one unsealed area comprises at least a first and a second unsealed areas at both longitudinal ends of the longitudinal member, and the at least one sealed area comprises at least a first sealed area between longitudinal side faces of the longitudinal member and longitudinal internal walls of the cavity.

9. An anode assembly according to claim 8, wherein the first sealed area further extends between a lower face of the longitudinal member and a base of the cavity.

10. An anode assembly according to claim 7, wherein the at least one unsealed area comprises packing material, the packing material being compressed to a nominal value sufficiently lower than its maximum compression ratio to allow expansion of the longitudinal member.

11. An anode assembly according to claim 10, wherein the packing material is rock wool.

12. An anode assembly according to claim 7, further comprising a support to which is attached the anode rod and a plurality of additional anode rods, a plurality of additional longitudinal members each interdependent with one end of one of the additional anode rods, and a plurality of additional carbon anodes, each including a cavity, wherein the additional longitudinal members are housed in the cavities of the additional longitudinal members.

13. An anode assembly according to claim 12, wherein the support extends horizontally perpendicular to the longitudinal member and the additional longitudinal members.

14. An anode assembly according to claim 7, wherein the at least one unsealed area further comprises a second unsealed area extending directly from an opposite one of the longitudinal ends of the longitudinal member.

15. An anode assembly according to claim 7, wherein the longitudinal member is not contacted by the sealing material in the at least one unsealed area.

16. An anode assembly intended for cells for production of aluminum by electrolysis, the anode assembly having an anode rod, a longitudinal member interdependent with one end of the anode rod and a carbon anode including a cavity in which is housed the longitudinal member for sealing the longitudinal member to the carbon anode, the longitudinal member having first and second opposed longitudinal ends, characterized in that the anode assembly further comprises a gap between the cavity and the longitudinal member, the gap including at least one sealed area containing a sealing material and a first unsealed area devoid of sealing material, the first unsealed area extending directly from and in contact with the first longitudinal end of the longitudinal member.

17. An anode assembly according to claim 16, wherein the gap further includes a second unsealed area extending directly from the second longitudinal end of the longitudinal member.

* * * * *